US007735173B2

(12) United States Patent
Kwon et al.

(10) Patent No.: US 7,735,173 B2
(45) Date of Patent: Jun. 15, 2010

(54) WASHING MACHINE AND CONTROLLING METHOD OF THE SAME

(75) Inventors: Ho Cheol Kwon, Changwon-si (KR); Hack Jai Song, Changwon-si (KR); Beom Jun Kim, Changwon-si (KR); Il Jyeok Yim, Gyeonggi-do (KR); Kang Mo Choi, Masan-si (KR)

(73) Assignee: LG Electronics Inc., Seoul (KR)

( * ) Notice: Subject to any disclaimer, the term of this patent is extended or adjusted under 35 U.S.C. 154(b) by 923 days.

(21) Appl. No.: 10/591,437

(22) PCT Filed: Nov. 11, 2005

(86) PCT No.: PCT/KR2005/003833

§ 371 (c)(1),
(2), (4) Date: Sep. 1, 2006

(87) PCT Pub. No.: WO2006/052106

PCT Pub. Date: May 18, 2006

(65) Prior Publication Data

US 2007/0186356 A1 Aug. 16, 2007

(30) Foreign Application Priority Data

Nov. 11, 2004 (KR) ..... 10-2004-0091955
Nov. 11, 2004 (KR) ..... 10-2004-0091956

(51) Int. Cl.
*D06F 33/02* (2006.01)

(52) U.S. Cl. ..... 8/159; 68/12.04; 68/12.12

(58) Field of Classification Search ..... 68/12.12, 68/12.14

See application file for complete search history.

(56) References Cited

U.S. PATENT DOCUMENTS

| | | | | |
|---|---|---|---|---|
| 5,165,260 | A * | 11/1992 | Geiger | 68/12.04 |
| 5,647,232 | A | 7/1997 | Bolt et al. | |
| 6,292,966 | B1 * | 9/2001 | Lim et al. | 8/158 |
| 6,401,284 | B1 * | 6/2002 | Jeon et al. | 8/158 |
| 7,451,510 | B2 * | 11/2008 | Lee | 8/158 |
| 7,530,132 | B2 * | 5/2009 | Kim | 8/158 |
| 7,530,133 | B2 * | 5/2009 | Mitts | 8/159 |

FOREIGN PATENT DOCUMENTS

| | | | |
|---|---|---|---|
| CH | 651 602 | * | 9/1985 |
| EP | 1 167 609 A1 | | 1/2002 |
| GB | 2 295 160 A | | 5/1996 |
| JP | 06-182082 | * | 7/1994 |

* cited by examiner

*Primary Examiner*—Frankie L Stinson
(74) *Attorney, Agent, or Firm*—Birch, Stewart, Kolasch & Birch, LLP

(57) ABSTRACT

A washing machine and a controlling method thereof are provided. The washing machine and controlling method use a sensor to sense a load of laundry at a predetermined point during a wash cycle, and controls the rotating speed of a drum based on whether the sensed load of laundry is a small load or a single article, in order to untangle laundry and implement a spin cycle.

16 Claims, 3 Drawing Sheets

[Fig. 1]
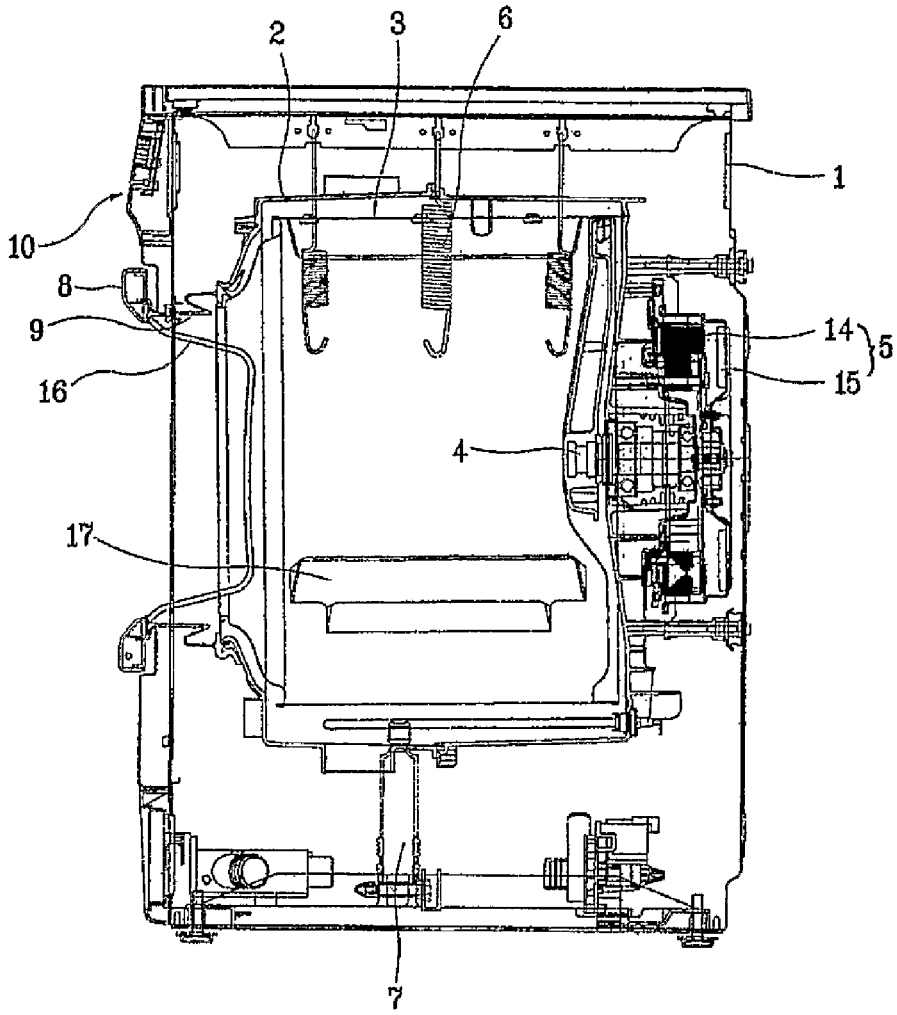
[Fig. 2]
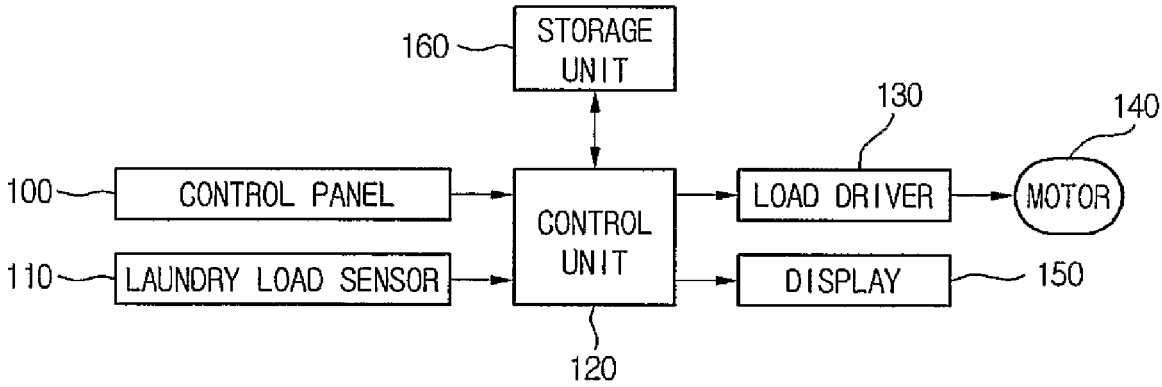

[Fig. 3]
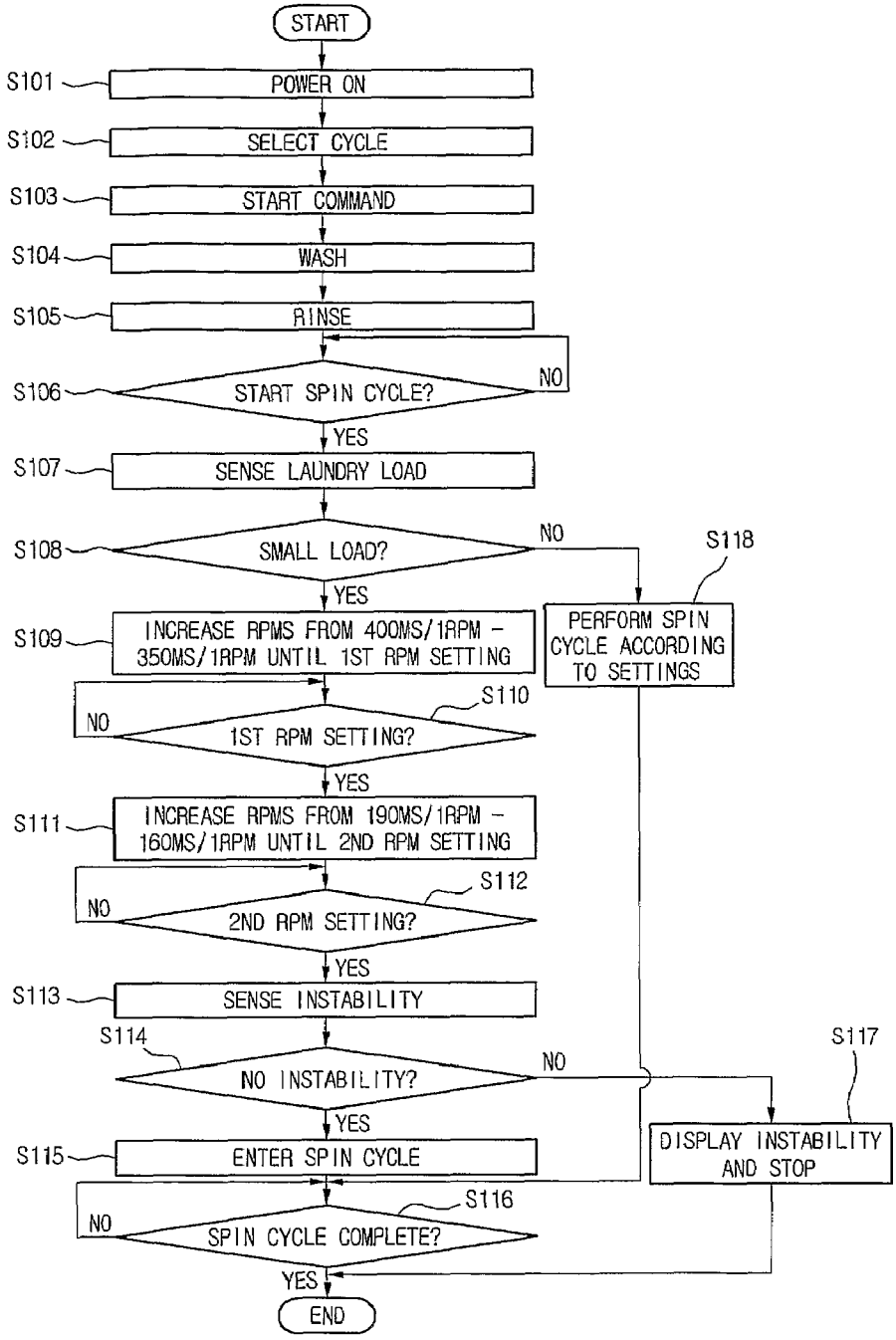
[Fig. 4]
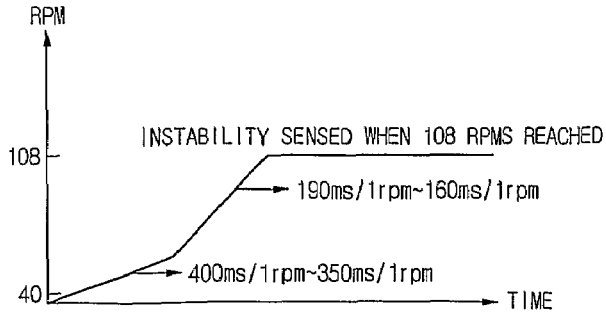

[Fig. 5]
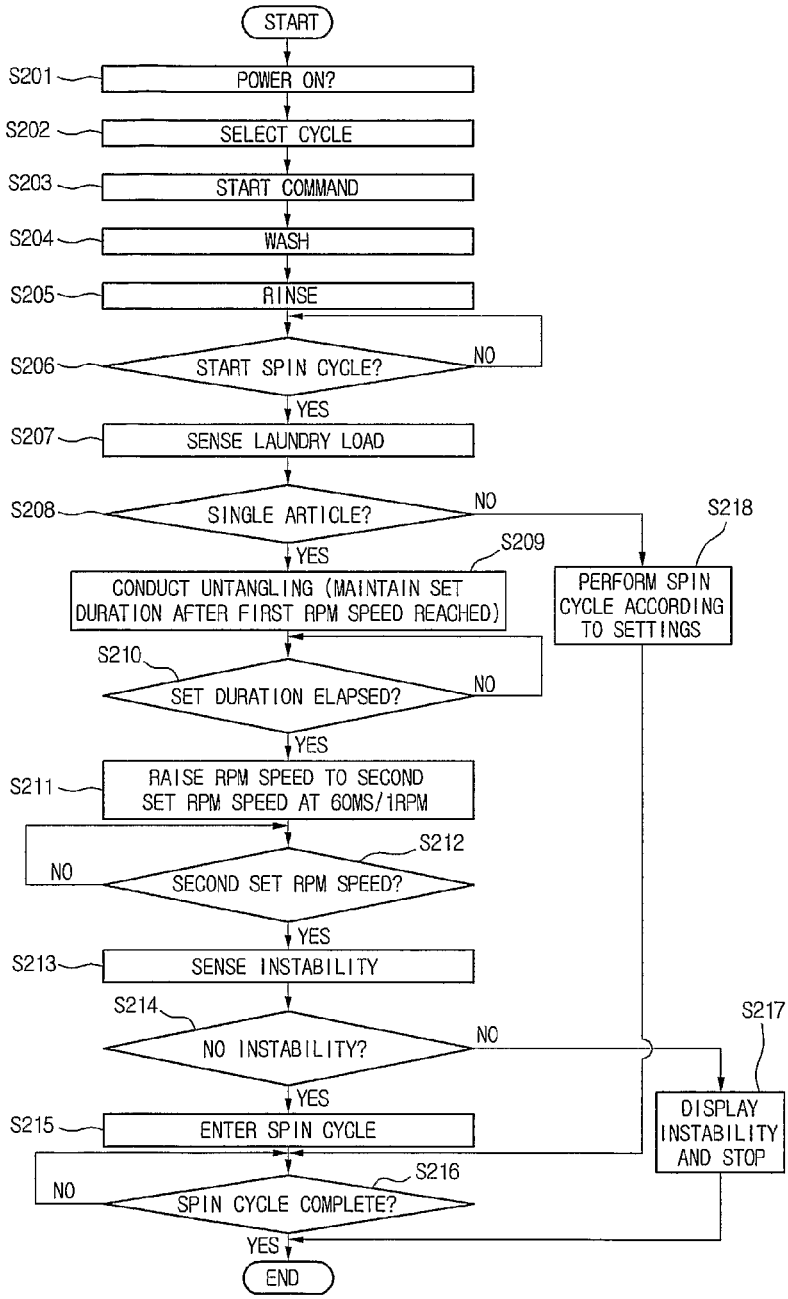
[Fig. 6]
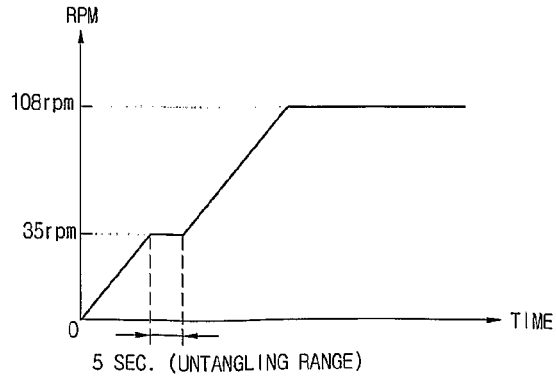

WASHING MACHINE AND CONTROLLING METHOD OF THE SAME

TECHNICAL FIELD

The present invention relates to a washing machine, and more particularly, to a drum-type washing machine and a controlling method thereof.

BACKGROUND ART

A washing machine is a washing apparatus that uses the driving force of a motor to spin a rotating tub and pulsator during wash, rinse, and spin cycles. After wash liquid and laundry are disposed inside the rotating tub, they are churned, so that the friction between the laundry, the wash liquid, and the inside of the rotating tub washes the laundry.

Such washing machines are divided into pulsator, agitator, and drum-type washing machines.

A drum-type washing machine disposes detergent and wash liquid together with a load of laundry inside a wash drum, and rotates the same by means of driving force from a drive unit, so that friction between the rotating wash drum and the laundry washes the laundry, with a minimum of damage incurred to the laundry, less tangling of the laundry, and provision of hand-washed results.

However, in the related art, the drum accelerates linearly to a preset rpm, instability is sensed when the preset rpm is reached, and then a spin cycle is begun. In such a method of linearly increasing rpms until a preset rpm value is reached, a problem arises during the spin cycle when the load of laundry is small. That is, because a small load of laundry will be insufficiently untangled, it will be sensed as a single article of laundry, so that the starting point of the spin cycle will be delayed, resulting in an improper starting of the spin cycle.

DISCLOSURE OF INVENTION

Technical Problem

An object of the present invention is to provide a washing machine and a controlling method thereof that senses if a load of laundry is small, minimizes tangling of laundry, and allows a spin cycle to begin in its due course.

Another object of the present invention is to provide a washing machine and a controlling method thereof that senses if a load of laundry is a single article, minimizes tangling of laundry, and allows a spin cycle to begin in its due course.

Technical Solution

To achieve these objects and other advantages in accordance with the present invention, as embodied and broadly described herein, there is provided a washing machine including: a control panel for selecting a wash cycle; a sensor for sensing a load of laundry inside a drum during an operation of the wash cycle selected through the control panel; and a control unit for conducting the wash cycle selected through the control panel, and controlling an rpm speed of the drum according to the sensed load of laundry sensed by the sensor for untangling the laundry.

In another aspect of the present invention, there is provided a controlling method of a washing machine having a control panel, a sensor, and a control unit, the controlling method including: selecting a wash cycle through the control panel and inputting operating commands; conducting the wash cycle selected through the control panel when the operating commands are inputted; sensing a load of laundry through the sensor when a spin cycle begins in the wash cycle; implementing an rpm accelerating rate of a drum differently and untangling the laundry, according to the sensed load of laundry; and conducting the spin cycle when the untangling of the laundry is completed.

In a further aspect of the present invention, there is provided a controlling method of a washing machine having a control panel, a sensor, and a control unit, the controlling method including: selecting a wash cycle through the control panel and inputting operating commands; conducting the wash cycle selected through the control panel when the operating commands are inputted; sensing through the sensor whether a load of laundry is a single article when a spin cycle begins in the wash cycle; rotating the drum at a predetermined rpm speed over a predetermined duration with the control unit according to whether the sensed load of laundry is a single article, and untangling the load of laundry; and beginning the spin cycle when the untangling of the load of laundry is completed.

ADVANTAGEOUS EFFECTS

The washing machine and the controlling method thereof according to the present invention apply an instability-sensing algorithm to differentiate a sensed small load of laundry from a large load, so that a spin cycle can be begun with laundry distributed evenly within the drum. Thus, a smooth start to the spin cycle can be achieved.

Also, the washing machine and the controlling method thereof according to the present invention apply an instability-sensing algorithm to differentiate a sensed single article of laundry from a load consisting of a plurality of articles, so that a spin cycle can be begun with laundry distributed evenly within the drum, for achieving a smooth start to the spin cycle.

Furthermore, the washing machine and the controlling method thereof according to the present invention minimize instability by beginning a spin cycle with laundry evenly distributed within the drum. Thus, the time it takes to begin the spin cycle is reduced, and the spin cycle effectiveness is increased.

BRIEF DESCRIPTION OF THE DRAWINGS

FIG. 1 is a schematic sectional view of a washing machine according to the present invention.

FIG. 2 is a block diagram showing a controlling structure of the washing machine according to the first embodiment of the present invention.

FIG. 3 is a flowchart showing a controlling method of the washing machine according to the first embodiment of the present invention.

FIG. 4 is a graph showing the controlling process of a small load of laundry in the controlling method according to the first embodiment of the present invention.

FIG. 5 is a is a flowchart showing a controlling method of the washing machine according to the second embodiment of the present invention.

FIG. 6 is a graph showing the controlling process of a small load of laundry in the controlling method according to the second embodiment of the present invention.

BEST MODE FOR CARRYING OUT THE INVENTION

Hereinafter, preferred embodiments of the present invention will be described in detail with reference to accompanying drawings. However, the embodiments are not limited to the scope of this invention, and can easily encompass added elements, variations, and deletions which fall within the scope of embodiments in retrogressive inventions or the present invention.

FIG. 1 is a schematic sectional view of a washing machine according to the present invention.

Referring to FIG. 1, a washing machine includes a main body 1, in which a tub 2 is supported by dampers 7 and springs 6, a cylindrical drum 3 installed to rotate around a horizontal axis within the tub 2, and a drive motor 5 axially coupled to the drum 3.

The drive motor 5 is disposed at the rear of the tub 2 and is formed with a rotor 15 and a stator 14. The rotor 15 is connected directly to a drum axis 4 in order to relay the rotational force of the rotor directly to the drum 3 and to rotate integrally with the drum 3 without the use of a pulley or a belt.

At the front of the main body 1 is a door 8 disposed at a predetermined location corresponding to an opening, between the door 8 and drum 3 is a gasket 9 for maintaining a seal, and above the door 8 is a control panel 10 for receiving user inputs and controlling the overall operation of the washing machine.

In the above-structured drum-type washing machine, the rotational force of the rotor 15 is relayed to the drum 3 through the drum axis 4, and when the drum 3 rotates, laundry is lifted by means of a lifter 17 and falls by means of gravity during the wash cycle.

Specifically, laundry that is lifted to the top portion of the drum 3 through its rotation falls due to gravity when it reaches a predetermined height and collides with wash liquid. With repetition of this process, the friction between the laundry and the wash liquid washes the laundry.

After washing is completed in the above process, a spin cycle is executed, in which a drain pump (not shown) is operated to drain the wash liquid through a drain hose (not shown), and the drum 3 is rotated at high speed to dehydrate the laundry through centrifugal force.

FIG. 2 is a block diagram showing a controlling structure of the washing machine according to the first embodiment of the present invention.

Referring to FIG. 2, the washing machine according to the present invention includes a control panel 100 for inputting a user's commands, a laundry load sensor 110 for sensing the amount of laundry in the washing machine after commands are inputted in the control panel 100, a control unit 120 for controlling the washing machine to carry out a wash cycle according to the course selected by a user and controlling the starting point of a spin cycle according to a load level sensed by the laundry load sensor 110, a motor 140 for implementing the wash cycle and a load driver 130 for controlling the operation of other devices according to a control signal from the control unit 120, a display 150 for displaying the operating status according to a control signal from the control unit 120, and a storage unit 160 for storing menus, etc.

The operation of the above-structured washing machine will now be described.

First, a user turns power on, inputs a desired wash cycle, and enters a start command through the control panel 100. Then, the display 150 displays the selected wash cycle and its operational status.

Washing and rinsing are implemented according to the inputted commands, and a spin cycle begins when the rinse cycle ends. Here, if the laundry amount is re-checked through the laundry load sensor 110 as the spin cycle is begun, when the load of the sensed laundry is a small load, the rotating speed of the drum (not shown) is divided into a plurality of ranges and the drum is driven variably in different ranges.

That is, if the load of the laundry is sensed to be small by the laundry load sensor 110, in the initial stage of the spin cycle in a range of approximately 40-50 rpms (where a small load does not tangle), a preset first accelerating rate (between 400 ms/1 rpm and 350 ms/1 rpm) is implemented to raise the spin speed up to a first rpm speed (50 rpms).

When the first rpm speed is surpassed, a second accelerating rate (between 190 ms/1 rmp and 160 ms/1 rmp) is implemented to raise the spin speed up to a second rpm speed (108 rpms). When the second rpm speed is reached, instability is measured.

Here, the instability value of the instability measurement result is lower than a preset individual value. When there is virtually no instability measured, a spin cycle is begun.

Taking into account that laundry does not untangle well and bundles up when a linearly increasing rate of speed is applied in the case of a small load of laundry and that a load of laundry will be interpreted as a single article when a measured instability value is large, the drum-type washing machine according to this embodiment momentarily delays the acceleration of a current rotational speed of the drum to untangle laundry in the first phase of the spin cycle, so that the laundry is evenly distributed before an instability measurement is taken.

FIG. 3 is a flowchart showing a controlling method of the washing machine according to the first embodiment of the present invention, and FIG. 4 is a graph showing the controlling process of a small load of laundry in the controlling method according to the first embodiment of the present invention. Referring to FIGS. 3 and 4, a description of the controlling method of the washing machine according to the first embodiment of the present invention will be described henceforth.

First, a user inputs a "power on" command, and selects a desired wash cycle in step S101 and S102.

After the wash cycle is selected, a start command for the wash and rinse cycles is inputted in step S103. After the wash and rinse cycles are performed in steps S104 and S105, it is determined in step S106 whether the spin cycle is beginning.

Then, according to the determining results from step S106, the amount of laundry (or load) is measured in step S107, and it is determined whether the load is a small load in step S108.

According to the determining results from step S108, if the load is determined to be small, a preset first accelerating rate (between 400 ms/1 rpm and 350 ms/1 rpm) is implemented to raise the spin speed up to a first rpm speed in step S109.

Next, it is determined in step S110 whether the first rpm speed is surpassed.

According to the determining results from step S110, when the first rpm speed is surpassed, a second accelerating rate (between 190 ms/1 rmp and 160 ms/1 rmp) is implemented in step S111 to raise the spin speed up to a second rpm speed (108 rpms).

Then, it is determined in step S112 whether the second rpm speed is reached.

According to the determining results from step S112, if the second rpm speed has been reached, an instability measurement is taken in step S113.

Subsequently, when it is determined in step S114 that there is no instability, the main spin cycle is begun in step S115 and carried out until a determining in step S116 if the spin cycle is completed.

If the determining in step S114 shows that there is instability, the instability is displayed and the spin cycle is stopped in step S117.

If the determining in step S108 shows that the load is larger than a small load, the spin cycle is implemented in step S118 according to the inputted settings.

The above-described drum-type washing machine and its instability measuring method according to the present invention are provided to measure instability of a small load, and apply a first rpm speed increase (that is a speed at which a small load of laundry evenly distributes in the drum) so that the small load does not tangle but evenly distributes inside the drum, and then begin the spin cycle.

Mode for the Invention

FIG. 5 is a is a flowchart showing a controlling method of the washing machine according to the second embodiment of the present invention, and FIG. 6 is a graph showing the controlling process of a small load of laundry in the controlling method according to the second embodiment of the present invention. Referring to FIGS. 5 and 6, a controlling method according to this embodiment will be described below.

In the description, content which overlaps with portions of the first embodiment described above will be omitted, and deemed replaced by the previous description.

First, a user inputs a "power on" command in step S201, and selects a desired course in step S201.

After the wash cycle is selected, a start command for the wash and rinse cycles is inputted in step S203. After the wash and rinse cycles are performed in steps S204 and S205, it is determined in step S206 whether the spin cycle is beginning.

Then, according to the determining results from step S206, the amount of laundry (or load) is measured in step S207, and it is determined whether the load is an individual load (that is, a single article of laundry) in step S208.

According to the determining results from step S208, if the load is determined to be a single article, a preset first accelerating rate (between 190 ms/1 rpm and 160 ms/1 rpm) is implemented to raise the spin speed up to a first rpm speed (c. 35-37 rpm) and maintain it for a preset duration in step S209. Here, the first rpm speed is a rotational range in which a single article of laundry will not tangle and rotate within the drum. The preset duration is several seconds (c. 5 seconds).

Next, it is determined in step S210 whether the first rpm speed has been surpassed.

According to the determining results from step S210, when the first rpm speed is surpassed, a preset accelerating rate of 60 ms/1 rmp is implemented in step S211 to raise the spin speed up to a second preset rpm speed.

Then, it is determined in step S212 whether the second rpm speed (108 rpms) is reached.

According to the determining results from step S212, if the second preset rpm speed has been reached, an instability measurement is taken in step S213.

Subsequently, when it is determined in step S214 that there is no instability, the main spin cycle is begun in step S215 and carried out until a determining in step S216 if the spin cycle is completed.

If the determining in step S214 shows that there is instability, the instability is displayed and the spin cycle is stopped in step S217.

If the determining in step S208 shows that the load is a single article, the spin cycle is implemented in step S218 according to the inputted settings.

The above-described washing machine and its controlling method according to the present invention are provided to maintain the rotating speed of the drum (not shown) within a range (in which a single article of laundry does not tangle while rotating) over a preset duration of a few seconds, and then implement a sudden accelerating rate, when a load of laundry is sensed as a single article. In this way, by sharply increasing the rotating speed of the drum to evenly distribute the single article therein and then taking an instability measurement, the beginning of the spin cycle can be controlled.

Similarly, after evenly distributing the single article, and measuring instability when the second rpm (of 108 rpms) is reached, there is virtually no instability, and the spin cycle can begin earlier.

INDUSTRIAL APPLICABILITY

The washing machine and the control method thereof according to the present invention can substantially reduce tangling of laundry for a smooth operation of the spin cycle, and thus, a high industrial applicability.

The invention claimed is:

1. A washing machine comprising:

a control panel for selecting a wash cycle;

a sensor for sensing a load of laundry inside a drum during an operation of the wash cycle selected through the control panel; and a control unit for conducting the wash cycle selected through the control panel and controlling an rpm speed of the drum according to the sensed load of laundry sensed by the sensor, for untangling the laundry, wherein the sensor senses the load of laundry inside the drum and the control unit establishes ranges when the load of laundry is sensed by the sensor to be under the specific load, and the control unit controls the accelerating rate of rpm speed of the drum in different accelerating rates.

2. The washing machine according to claim 1, wherein the specific load is small to medium or a smaller load.

3. The washing machine according to claim 1, wherein the established ranges include a first range between 400 ms/1 rpm and 350 ms/1 rpm and a second range between 190 ms/1 rpm and 160 ms/1 rpm for raising the rpm speed of the drum at an accelerating rate.

4. A washing machine comprising:

a control panel for selecting a wash cycle;

a sensor for sensing a load of laundry inside a drum during an operation of the wash cycle selected through the control panel; and a control unit for conducting the wash cycle selected through the control panel and controlling an rpm speed of the drum according to the sensed load of laundry sensed by the sensor, for untangling the laundry, wherein the control unit controls a spin cycle according to whether the load of laundry sensed by the sensor is a single article, when the rinse cycle is begun.

5. The washing machine according to claim 4, wherein if the load of laundry sensed by the sensor is a single article, an untangling cycle for rotating the drum at a predetermined rpm speed over a predetermined duration is implemented.

6. The washing machine according to claim 5, wherein the predetermined rpm speed at which the drum is rotated in the untangling cycle is in a range of 35 to 37 rpms.

7. The washing machine according to claim 5, wherein the untangling cycle includes an rpm accelerating rate thereafter a predetermined amount greater than an rpm accelerating rate therebefore.

8. The washing machine according to claim 5, wherein the untangling cycle includes an rpm accelerating rate therebefore of between 190 ms/1 rpm and 160 ms/1 rpm, and an rpm accelerating rate thereafter of 60 ms/1 rpm.

9. A controlling method of a washing machine having a control panel, a sensor, and a control unit, the controlling method comprising:

selecting a wash cycle through the control panel and inputting operating commands;

conducting by the control unit of the wash cycle selected through the control panel when the operating commands are inputted;

sensing a load of laundry through the sensor when a spin cycle begins in the wash cycle;

implementing by the control unit of an rpm accelerating rate of a drum differently and untangling the laundry, according to the sensed load of laundry; and conducting the spin cycle when the untangling of the laundry is completed, wherein the untangling of the laundry includes:

raising an rpm speed of the drum to a preset first rpm speed at a preset first rpm accelerating rate and rotating the drum, when the load of laundry is sensed to be a small load; and raising the rpm speed of the drum to a preset second rpm speed at a preset second rpm accelerating rate and rotating the drum, when the preset first rpm speed is reached.

10. The controlling method according to claim 9, wherein the first rpm accelerating rate is in a range between 400 ms/1 rpm and 350 ms/1 rpm, and the second rpm accelerating rate is in a range between 190 ms/1 rpm and 160 ms/1 rpm.

11. The controlling method according to claim 9, wherein the conducting of the spin cycle includes:

sensing instability when the second rpm speed is reached, and beginning the spin cycle when instability is not sensed in the sensing of the instability.

12. A controlling method of a washing machine having a control panel, a sensor, and a control unit, the controlling method comprising:

selecting a wash cycle through the control panel and inputting operating commands;

conducting by the control unit of the wash cycle selected through the control panel when the operating commands are inputted;

sensing through the sensor whether a load of laundry is a single article when a spin cycle begins in the wash cycle;

rotating by the control unit of the drum at a predetermined rpm speed over a predetermined duration with the control unit according to whether the sensed load of laundry is a single article, and untangling the load of laundry; and beginning the spin cycle when the untangling of the load of laundry is completed, wherein the untangling of the load of laundry includes:

raising the rpm speed of the drum to the predetermined rpm speed at a first accelerating rate and rotating the drum, when the load of laundry is sensed to be a single article:

maintaining the preset rpm speed and rotating the drum over the predetermined duration, when the predetermined rpm speed is reached; and raising the rpm speed of the drum by a second accelerating rate when the predetermined duration is elapsed.

13. The controlling method according to claim 12, wherein the predetermined rpm speed at which the drum is rotated is in range of 35 to 37 rpms.

14. The controlling method according to claim 12, wherein the spin cycle includes:

sensing instability after the raising of the rpm speed of the drum at the second accelerating rate; and conducting the spin cycle when instability is not sensed in the sensing of instability.

15. The controlling method according to claim 12, wherein the second accelerating rate is greater by a predetermined amount than the first accelerating rate.

16. The controlling method according to claim 12, wherein the first accelerating rate lies in a range between 190 ms/1 rpm and 160 ms/1 rpm, and the second accelerating rate is 60 ms/1 rpm.

* * * * *